US005716922A

United States Patent [19]

Curry et al.

[11] Patent Number: 5,716,922

[45] Date of Patent: Feb. 10, 1998

[54] DETERGENT GELS

[75] Inventors: John Downing Curry, Oxford; Alan Edward Sherry, Cincinnati, both of Ohio; Dale Alan Gregory, Lawrenceburg, Ind.; Edgar Manual Marin Carrillo, Caracas, Venezuela

[73] Assignee: The Procter & Gamble Company, Cincinnati, Ohio

[21] Appl. No.: 760,015

[22] Filed: Nov. 20, 1996

Related U.S. Application Data

[63] Continuation of Ser. No. 483,599, Jun. 7, 1995, abandoned, which is a continuation of Ser. No. 184,731, Jan. 18, 1994, abandoned, which is a continuation of Ser. No. 971,493, Nov. 4, 1992, abandoned.

[51] Int. Cl.[6] ..... C11D 1/29; C11D 1/83; C11D 3/32

[52] U.S. Cl. ..... 510/237; 134/25.2; 510/403; 510/423; 510/424; 510/427; 510/433; 510/502

[58] Field of Search ..... 510/237, 403, 510/423, 424, 427, 433, 502; 134/25.2

[56] References Cited

U.S. PATENT DOCUMENTS

| | | | |
|---|---|---|---|
| 2,965,576 | 12/1960 | Wilson | 252/548 |
| 3,312,627 | 4/1967 | Hooker | 252/152 |
| 3,576,749 | 4/1971 | Megson et al. | 252/132 |
| 4,615,819 | 10/1986 | Leng et al. | 252/110 |

FOREIGN PATENT DOCUMENTS

| | | | |
|---|---|---|---|
| 0 285 768 | 10/1988 | European Pat. Off. . | |
| 1 580 491 | 9/1969 | France . | |
| 809060 | 2/1959 | United Kingdom . | |
| WO 92/06156 | 4/1992 | WIPO . | |
| WO 92/06171 | 4/1992 | WIPO . | |
| WO 93/05132 | 3/1993 | WIPO | C11D 1/65 |

*Primary Examiner*—Paul Lieberman
*Assistant Examiner*—Gregory R. Delcotto
*Attorney, Agent, or Firm*—Ken K. Patel; Jacobus C. Rasser; Kim W. Zerby

[57] ABSTRACT

Gelled detergent compositions comprise a polyhydroxy fatty acid amine surfactant and an alkyl alkoxylated sulfate surfactant. Gels form spontaneously without the need for extraneous gelling agents. Thus, a mixture of coconutalkyl N-methyl glucamide and an AEmS surfactant gels in water to provide a composition which is useful for cleaning hard surfaces, especially tableware. Grease-cutting gels which contain magnesium and/or calcium ions are also provided.

10 Claims, No Drawings

DETERGENT GELS

This is a continuation of application Ser. No. 08/483,599, filed on Jun. 7, 1995, now abandoned, which is a continuation of Ser. No. 08/184,731, filed on Jan. 18, 1994, now abandoned, which is a continuation of application Ser. No. 07/971,493, filed on Nov. 4, 1992, now abandoned.

FIELD OF THE INVENTION

Detergent compositions in gel form comprise polyhydroxy fatty acid amide surfactants and alkyl alkoxylated sulfate surfactants. Such compositions are especially useful and convenient for hand dishwashing operations.

BACKGROUND OF THE INVENTION

The user of modern detergent compositions has appreciated the advantages of having such compositions available in a wide variety of forms, not only for convenience, but also for performance and aesthetic reasons. Accordingly, formulators of such compositions have made substantial efforts to provide detergent compositions as bars, flakes, spray-dried granules, and liquids. Most recently, a substantial proportion of consumers have begun using detergents which are available in gel form. In some Latin American countries, such as Venezuela, gel detergents are available in tub containers, and are especially popular and preferred for home dishwashing operations. Following local habits and practices, the gel is applied directly to a sponge or other wiping implement, and applied with water to the eating or cooking utensil being cleansed. Accordingly, formulators have turned increasing attention to the problems associated with the formulation of high quality, stable and economical gel detergent compositions.

The formulation of gels is a complex phenomenon involving the association of solute molecules in an aqueous medium. While a precise definition of the gel state is difficult, most aqueous gels can be considered as having most of the properties of a solid or semi-solid, while still containing as high as 99% water. Gels of the type used in gel detergents provided herein are typically in the form of gelatinized or gelled compositions which can have viscosities as high as 5,000,000 centipoise, and typically range from about 500,000 to about 4,000,000 centipoise.

A wide variety of means have been used to form gels, and standard formularies reveal that various commercial gums are used for this purpose in various consumer products. See, for example, M. G. deNavarre "The Chemistry and Manufacture of Cosmetics" Vol. III 2nd ed. 1975 Continental Press, Orlando, Fla. USA.

However, it transpires that the formation of stable, attractive, high viscosity detergent gels at an economical price is still under active investigation. It is known, for example, that some gels are heterogeneous, and phase separation can undesirably occur in such gels. Some gels are relatively unstable on storage, especially at the relatively high temperatures that can occur on warehousing and shipping finished product. Other gels can be disrupted by ionic ingredients present in their aqueous phase. Since many detergent ingredients are ionic, this can be especially problematic. Gelling agents which may be usable in high-fashion, expensive cosmetics may not be affordable in products such as dishwashing detergents, and the like.

The present invention provides high cleaning, high sudsing detergent compositions in the form of stable, economical, highly attractive gels.

BACKGROUND ART

EPO 285,768, H. Kelkenberg, published Feb. 10, 1988, relates to the use of polyhydroxy alkyl fatty acid amides in thickened compositions containing other thickening agents and paraffin sulfonates. U.K. 809,060, published Feb. 18, 1959, corresponding to U.S. Pat. No. 2,965,576, Wilson, issued Dec. 20, 1960, relates to the use of polyhydroxy fatty acid amides with various anionic surfactants. French 1,580,491, M. Lordonnois, published Sep. 5, 1969, also relates to detergent compositions with various additives, including certain polyhydroxy fatty acid amides.

The use of polyhydroxy fatty acid amides in toilet bar compositions with other specified ingredients is disclosed in U.S. Pat. No. 3,312,627, Hooker, issued Apr. 4, 1967 and U.S. Pat. No. 3,576,749, Megson et al, issued Apr. 27, 1991.

SUMMARY OF THE INVENTION

EPO 285,768, noted above, relates inter alia to the problems associated with the formation of thickened liquid surfactant systems containing paraffin sulfonates and coconut fatty acid dialkanolamides and/or polyoxyethylene-propylene glycol dioleate thickeners. In the practice of the present invention the use of the paraffin sulfonate class of anionic surfactants is avoided. By thus preparing compositions free from amounts of paraffin sulfonates which would otherwise be problematic according to the teachings of '768 and turning instead to other types of anionic surfactants, the remarkable observation has now been made that not merely "thickened" liquids but outright gels can be formed without resort to any extraneous gelling agents. While not intending to be limited by theory, it appears that the gels formed herein comprise liquid crystals, quite probably of the so-called middle phase, rather than the cross-connected gel structure proposed for conventional polymeric gelling agents.

This invention provides detergent compositions in gel form, comprising water and at least about 15% by weight of total gel of a mixture of a polyhydroxy fatty acid amide surfactant (a) and an anionic surfactant (b) which is an alkyl alkoxylated sulfate surfactant, said mixture of surfactants (a) and (b) being in a weight ratio of from about 1:10 to about 10:1. Preferred gels typically comprise at least about 20%, most preferably from about 25% to about 60% by weight of the mixture of surfactants (a) and (b). Up to about 80% by weight of the preferred gels will comprise water.

The coconutalkyl ($C_{12}$–$C_{14}$) polyhydroxy fatty acids can be used to prepare gels which are clear and water-white. The palm and tallow ($C_{16}$–$C_{20}$) polyhydroxy fatty acid amides tend to yield gels which are translucent. Thus, the type of gel can be varied to meet the needs of the formulator by proper selection of the polyhydroxy fatty acid amide.

The preferred gel compositions herein are substantially free of polymeric gelling agents, and substantially free of paraffin sulfonate surfactants. Such preferred gels have viscosities in the range from about 500,000 cps to about 4,000,000 cps.

High grease-cutting detergent gels herein which are especially useful for hand-washing dishware (including eating utensils) additionally comprise a source of magnesium ions, said source being either a conventional water-soluble magnesium salt or the magnesium salts of said alkyl alkoxylated sulfate surfactant, or mixtures thereof. Preferred magnesium ion containing gels comprise at least about 10% by weight of said magnesium salts of the alkyl alkoxylated surfactant. Compositions containing a source of calcium ions, or a mixture of magnesium and calcium ions, are also provided.

The compositions herein can also contain additional surfactants, especially members selected from the group consisting of ethoxylated alcohols, amine oxides, betaines, sultaines, and mixtures thereof. Such compositions with betaine surfactants are especially preferred when magnesium and/or calcium ions are incorporated in the gels of this invention.

The invention herein also comprises a method for cleansing dishware by applying thereto a gel composition according to this invention in the presence of water and mechanical agitation, especially in the presence of a source of magnesium ions, most preferably the magnesium salts of the alkyl alkoxylated surfactant.

The invention also encompasses a process for manufacturing detergent gels without the need for polymeric gelling agents by combining the ingredients in the proportions disclosed above. Methods for providing magnesium and calcium ions in such gels are also encompassed herein.

All percentages, ratios and proportions herein are by weight, unless otherwise specified. All cited documents are incorporated herein by reference.

DETAILED DESCRIPTION OF THE INVENTION

The compositions and processes of this invention most preferably employ high quality polyhydroxy fatty acid amide surfactants which are substantially free of cyclized and ester-amide by-products. For high sudsing compositions, especially hand-wash, most especially hand dishwashing where the consumer expects high, persistent suds, the polyhydroxy fatty acid amides preferably should also be substantially free of contamination by residual sources of fatty acids. The following preparative methods afford the desired materials using conventional, mainly renewable resources, and are described herein in some detail, including the optional step of reducing the level of free fatty acids in the primary reaction by minimizing moisture content, and in the reduction of nascent fatty acid levels by means of the secondary reaction involving an amine and the undesired nascent source of fatty acid. Thus, the methods disclosed herein provide an overall commercial-type process, beginning with the formation of the polyhydroxy amine, followed by its conversion into the polyhydroxy fatty acid amide (hereinafter "Primary Reaction"), optionally followed by the reduction (hereinafter "Secondary Reaction") in residual nascent fatty acid levels, especially if high sudsing is desired, since nascent fatty acids can reduce suds levels, followed by partial sulfation.

As an overall proposition, the preparative method described hereinafter will afford high quality N-alkylamino polyol reactants with desirable low Gardner Color and which are substantially free of nickel catalysts. Such N-alkylamino polyols can then be reacted with, preferably, fatty acid methyl esters to provide high yields (90–98%) of polyhydroxy fatty acid amides having desirable low levels (typically, less than about 0.1%) of cyclized by-products and also with improved color and improved color stability, e.g., Gardner Colors below about 4, preferably between 0 and 2. The content of nascent fatty acids present in the polyhydroxy fatty acid amide is optionally minimized by the Secondary Reaction with amines, as disclosed herein. It will be understood that the nascent fatty acids are not thereby removed from the final product, but are converted into amido forms which can be tolerated in finished detergent compositions, even in liquid detergent compositions which contain calcium or magnesium cations. Indeed, by judicious selection of amines such as ethanolamine, the fatty acid monoethanolamides resulting from the secondary reaction are, themselves, desirable cleaning and suds-boosting ingredients, especially in gel dishwashing detergents.

The following describes the reactants and reaction conditions for the overall process.

By "substantially water-free" or like terminology used herein is meant that all reactants, solvents, catalysts and apparatus are employed in as water-free state as is reasonably possible. Typically, solvents may be dried using molecular sieves; apparatus is swept dry with dry gas; reactants preferably contain the minimum possible amount of water. Typically, the moisture content of the reactants, solvents, etc., will be in the range of 0.2%, more preferably 0.1%, or less.

By "substantially free of nickel" herein is meant that the N-alkylamino polyol used in the primary reaction contains no more than about 20 parts per million (ppm) nickel, and preferably less than about 5 ppm nickel ($Ni^{++}$). Nickel can be conveniently measured by conventional atomic absorption spectroscopy, using diluted samples (5/1 dilution to minimize interference).

By "reducible compounds" or "reducibles" herein is meant chemical compounds which contain reducing sugars either in their natural state or as an adduct with the amine such as N-methylglucamine. Such compounds include, but are not limited to, species such as glucose, fructose, maltose, xylose, N-methylglucosylamine, N-methylfructosylamine, N-methyl-N-glucosylglucamine. This is measured by g.c. analysis.

By "g.c. analysis" herein is meant gas-liquid chromatography ("g.l.c.") using Hewlett-Packard 5890 Series 2 on column injection using DB1 15 meter 0.25μ film thickness ID 250μ.

By "improved color" and/or "improved color stability" herein is meant the Gardner Color of the N-alkylamino polyol reactant used in the present process. Moreover, the Gardner Color of the fatty amide surfactants which are subsequently made therefrom is also substantially improved.

By "Gardner Color" herein is meant the standard Gardner measurement known in the art. A Gardner Color reading near zero (solution) represents a nearly colorless ("water-white") solution. Gardner Colors in the 4–7 range are only marginally acceptable for the N-alkylamino polyol reaction products, and it is preferred to achieve Gardner Colors below about 4, preferably 0 to about 2. Of course, use of sugars having low Gardner Colors (e.g., 0 or 1, i.e., water-white syrups) will help ensure that N-alkylamino polyols having desirably low Gardner Colors will be produced. Stated otherwise, use of low (0–2) Gardner Color sugars (preferably white solids or water-white solutions) and use of the reaction sequence disclosed herein results in low Gardner Color N-alkylamino polyols (white or slightly off-white solids).

By "improved odor" herein is meant that the odor character of the reaction product is substantially free of amine or "fish" type odor (once any excess N-alkylamine is removed) and also substantially free of typical browning sugar odors.

By "nickel catalyst" herein is meant any of the conventional Raney nickel or "supported" nickel catalysts well-known in the art. Conventional nickel under the trademark RANEY NICKEL 4200 (Grace Chemicals) is quite suitable for use herein. RANEY NICKEL 3200, (United Catalyst, Inc.) UCI; G-96B and G-49A and G-49C are also suitable. While not intending to be limited by theory, it is believed that removing oxides of nickel from the catalyst prevents or impedes dissolution of nickel ions into the reaction milieu, and thus results in the formation of reaction products having a desirable low nickel content. Moreover, it has been found that the nickel catalyst pre-treated with pressurized hydrogen can be re-used in multiple subsequent reactions, thereby yielding a substantial overall cost savings.

By "pressurized hydrogen" or "hydrogen pressure" in the polyhydroxy amine-forming reaction herein is meant: for treatment of the nickel catalyst typically 500 psig –5,000 psig; for reaction of the N-alkylamine and sugar (steps c and d below), typically 200 psig–5,000 psig.

By "sugars" in the polyhydroxy amine-forming reaction herein is meant reducing sugars such as glucose, fructose, mannose, lactose, maltose, xylose and the like. The term "sugars" herein also includes glyceraldehyde, although, as noted hereinafter, it may be simpler to use other reaction sequences in the manufacture of materials wherein Z=2. Such "sugars" include plant syrups such as cane syrups, corn syrups, potato starch-derived sugar syrups, hydrolyzed wood pulp-derived sugars and the like. High fructose, high glucose, high xylose and high maltose syrups are economical and preferred, especially if their Gardner Color is satisfactory.

By "N-alkylamines" in the polyhydroxy amine-forming reaction herein is meant compounds such as the N-methyl, N-ethyl, N-propyl, etc., $C_1$–$C_{10}$ N-alkylamines, and the corresponding hydroxy-substituted amines, e.g., ethanolamine. The $C_1$–$C_3$ alkylamines are preferred, and N-methylamine is most preferred.

By "amine reactant" in the secondary reaction to reduce fatty acid levels herein is meant, as noted above, $C_1$–$C_4$ amines and alkanolamines, examples of which include monoethanolamine (preferred), propylamine, ethylamine, 3-amino-1,2-propanediol, 1-amino-2-propanol, 3-amino-1-propanol, tris-(hydroxymethyl)aminoethane, 2-amino-2-ethyl-1,3-propanediol, ammonia, and the like.

By "free fatty acids" herein is meant the fatty acids per se, or salts thereof, e.g., sodium salts, i.e., soaps.

By "residual nascent source of fatty acids" herein is meant, for example, unreacted fatty acid ester starting materials, complex ester-amides which unavoidably form in small amounts during the primary reaction, and any other potential source of free fatty acid. It will be appreciated by the chemical formulator that during the overall reaction, work-up and storage of the polyhydroxy fatty acid amide surfactants, such nascent sources of fatty acids can break down in the presence of water in even modestly basic or acidic conditions to release the undesired fatty acids.

By "cyclized by-products" herein is meant the undesirable reaction by-products of the primary reaction wherein it appears that the multiple hydroxyl groups in the polyhydroxy fatty acid amides can form ring structures which are, in the main, not readily biodegradable. It will be appreciated by those skilled in the chemical arts that the preparation of the polyhydroxy fatty acid amides herein using the di- and higher saccharides such as maltose will result in the formation of polyhydroxy fatty acid amides wherein linear substituent Z (which contains multiple hydroxy substituents) is naturally "capped" by a polyhydroxy ring structure. Such materials are not cyclized by-products, as defined herein.

Formation of N-Alkylamino Polyol Raw Material

The preparation of the N-alkylaminol polyols used herein can be conducted in any well-stirred pressure vessel suitable for conducting hydrogenation reactions. In a convenient mode, a pressure reactor with a separate storage reservoir is employed. The reservoir (which, itself, can be pressurized) communicates with the reactor via suitable pipes, or the like. In use, a stirred slurry of the nickel catalyst is first treated with hydrogen to remove traces of nickel oxides. This can be conveniently done in the reactor. (Alternatively, if the manufacturer has access to an oxide-free source of nickel catalyst, pretreatment with $H_2$ is unnecessary. However, for most manufacturing processes some trace of oxides will inevitably be present, so the $H_2$ treatment is preferred.) After removal of excess slurry medium (water) the N-alkyl amine is introduced into the reactor. Thereafter, the sugar is introduced from the storage reservoir into the reactor either under hydrogen pressure or by means of a high pressure pumping system, and the reaction is allowed to proceed. The progress of the reaction can be monitored by periodically removing samples of the reaction mixture and analyzing for reducibles using gas chromatography ("g.c."), or by heating the sample to about 100° C. for 30–60 minutes in a sealed vial to check for color stability. Typically, for a reaction of about 8 liters (ca. 2 gallons) size the initial stage (to 95% of reducibles being depleted) requires about 60 minutes, depending somewhat on catalyst level and temperature. The temperature of the reaction mixture can then be raised to complete the reaction (to 99.9% of the reducibles being depleted).

In more detail, the process for preparing N-alkylamino polyols by reacting an N-alkylamine with a reducing sugar in the presence of a nickel catalyst under hydrogen pressure preferably will comprise:

(a) removing substantially all oxides of nickel from the nickel catalyst (conveniently, this can be done by contacting the nickel catalyst with hydrogen, typically under pressure and temperature of 50°–185° C. at 500–1,500 psig hydrogen);

(b) admixing the nickel catalyst from (a) with the N-alkylamine to provide mixture (b) under hydrogen pressure prior to admixture with the sugar;

(c) admixing the sugar with mixture (b) under hydrogen pressure;

(d) conducting the reaction of the sugar with the N-alkylamine/nickel catalyst mixture (b) at a temperature below about 80° C. and under hydrogen pressure (typically at least 250 psig, preferably at least 500 psig) until at least about 95% by weight of the reducible compounds are no longer present in the reaction mixture;

(e) continuing the reaction, optionally at a temperature of up to about 120° C., until at least about 99.9% by weight of the reducible compounds are no longer present in the reaction mixture; and (f) recovering the N-alkylamino polyol, preferably without purification.

A typical method is wherein the nickel catalyst level is in the range of from about 5% to about 50%, most typically about 10% to about 30%, by weight of the sugar reactants, for optimal throughput. Preferably step (d) is carried out at a temperature of from about 40° C. to about 70° C. Step (e) is preferably carried out at a temperature from about 80° C. to about 120° C. The catalyst may be used in repeat batches, as is.

The above process thus affords a convenient reaction for the preparation of compounds which include, but are not limited to, N-alkyl glucamine, N-alkyl fructamine, N-alkyl maltamine, N-alkyl xylamine, or N-alkyl glycerol amine, comprising the steps of:

(a) admixing a nickel catalyst which is substantially free of oxides of nickel with an N-alkylamine (preferably N-methylamine);

(b) under hydrogen pressure, admixing an aqueous solution of glucose, fructose, maltose or glyceraldehyde, respectively, with the mixture from step (a);

(c) allowing the mixture from step (b) to react at a temperature of from about 40° C. to about 70° C. until at least about 95% by weight of the reducible compounds are no longer present in the reaction mixture; and (d) allowing the reaction from step (c) to continue at a temperature below about 120° C. until at least about 99.9% by weight of the reducible compounds are no longer present in the reaction mixture.

Preferably the process is conducted with said catalyst being present at the 10% to 30% level relative to sugar.

When preparing 1,2-propanediol derivatives (e.g., N-alkyl glycerol amines) the formulator may elect to react an N-alkylamine with, for example, 3-chloro-1,2-propanediol or glycidol, at room temperature to about 65° C., typically in ethanol or water.

Primary Reaction to Form Polyhydroxy Fatty Acid Amides

The primary reaction herein for preparing polyhydroxy fatty acid amide surfactants, comprises reacting a member selected from the group consisting of, preferably, fatty acid esters with an N-alkylamino polyol. In a preferred method, the fatty acid ester is a $C_{10}$–$C_{18}$ alkyl or alkenyl fatty acid methyl ester and the N-alkylamino polyol is selected from N-methyl glucamine, N-methyl fructamine, N-methyl maltamine, N-methyl xylamine and N-methyl glycerol amine.

The amide-forming primary reaction herein can be illustrated by the formation of N-lauroyl N-methyl glucamine, as follows.

$$R^2COOMe + MeN(H)CH_2(CHOH)_4CH_2OH \xrightarrow[\text{methoxide}]{\text{methanol}} R^2C(O)N(Me)CH_2(CHOH)_4CH_2OH + MeOH$$

wherein $R^2$ is $C_{11}H_{23}$ alkyl.

More generally, the process herein can be used to prepare polyhydroxy fatty acid amide surfactants of the formula:

$$R^2-\overset{\overset{O}{\|}}{C}-\overset{\overset{R^1}{|}}{N}-Z \qquad (I)$$

wherein: $R^1$ is H, $C_1$–$C_4$ hydrocarbyl, 2-hydroxyethyl, 2-hydroxypropyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl moiety, preferably straight chain $C_7$–$C_{19}$ alkyl or alkenyl, more preferably straight chain $C_9$–$C_{17}$ alkyl or alkenyl, most preferably straight chain $C_{11}$–$C_{19}$ alkyl or alkenyl, or mixture thereof; and Z is a polyhydroxyhydrocarbyl moiety having a linear hydrocarbyl chain with at least 2 (in the case of glyceraldehyde) or 3 hydroxyls (in the case of other reducing sugars) directly connected to the chain, or an alkoxylated derivative (preferably ethoxylated or propoxylated) thereof. Z preferably will be derived from a reducing sugar in a reductive amination reaction; more preferably Z is a glycityl moiety. Suitable reducing sugars include glucose, fructose, maltose, lactose, galactose, mannose, and xylose, as well as glyceraldehyde. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')—(CHOH)—CH_2OH$, where n is an integer from 1 to 5, inclusive, and R' is H or a cyclic mono- or polysaccharide, and alkoxylated derivatives thereof. Most preferred are glycityls wherein n is 4, particularly $—CH_2—(CHOH)_4—CH_2OH$.

In Formula (I), $R^1$ can be, for example, N-methyl, N-ethyl, N-propyl, N-isopropyl, N-butyl, N-isobutyl, N-2-hydroxy ethyl, or N-2-hydroxy propyl.

$R^2—CO—N<$ can be, for example, cocamide, stearamide, oleamide, lauramide, myristamide, capricamide, palmitamide, tallowamide, etc.

Z can be 1-deoxyglucityl, 2-deoxyfructityl, 1-deoxyxylityl, 1-deoxymaltityl, 1-deoxylactityl, 1-deoxygalactityl, 1-deoxymannityl, 1-deoxymaltotriotityl, 2,3-dihydroxypropyl (from glyceraldehyde), etc.

The following reactants, catalysts and solvents can conveniently be used herein, and are listed only by way of exemplification and not by way of limitation.

Reactants—As noted above, various fatty ester reactants can be used herein, but fatty methyl esters are most preferred. Various other fatty esters can be used in the primary reaction, including mono-, di- and tri-esters (i.e., triglycerides). Methyl esters are convenient and commercially available with low Gardner Color, and ethyl esters, and the like are all quite suitable. The polyhydroxyamine reactants include N-alkyl and N-hydroxyalkyl polyhydroxyamines with the N-substituent group such as $CH_3$—, $C_2H_5$—, $C_3H_7$—, $HOCH_2CH_2$—, and the like. As noted above, such materials preferably are substantially free of nickel catalysts. Mixtures of the ester and mixtures of the polyhydroxyamine reactants can also be used.

Catalysts—The catalysts used in the primary reaction are basic materials such as the alkoxides (preferred), hydroxides—if provision is made to remove water from them and polyhydroxyamine prior to addition of ester—carbonates, and the like. Preferred alkoxide catalysts include the alkali metal $C_1$–$C_4$ alkoxides such as sodium methoxide, potassium ethoxide, and the like. The catalysts can be prepared separately from the reaction mixture, or can be generated in situ using an alkali metal such as sodium. For in situ generation, e.g., sodium metal in the methanol solvent, it is preferred that the other reactants not be present until catalyst generation is complete. The catalyst typically is used at 0.1–10, preferably 0.5–5, most preferably 5 mole percent of the ester reactant. Mixtures of catalysts can also be used.

Solvents—The organic hydroxy solvents used in the primary reaction include methanol, ethanol, glycerol, 1,2-propanediol, 1,3-propylene glycol, and the like. Methanol is a preferred alcohol solvent and 1,2-propanediol (propylene glycol) is a preferred diol solvent. Mixtures of solvents can also be used.

General Reaction Conditions—As noted, it is desired to prepare the products of the primary reaction (amidation) while minimizing the formation of cyclized by-products, ester amides and color bodies. Reaction temperatures below about 135° C., typically in the range of from about 40° C. to about 100° C., preferably 60° C. to 90° C., are used to achieve this objective, especially in batch processes where reaction times are typically on the order of about 90 minutes, or even up to 3 hours. Most preferably, this reaction is conducted at 85° C. Somewhat higher temperatures can be tolerated in continuous processes, where residence times can be shorter. All reactants, catalysts, solvents, etc. should be substantially dry. For example, the fatty esters and N-methyl glucamine preferably contain less than about 0.1% water. The concentration ranges of the reactants and solvent provide, for example, what can be termed a "70% concentrated" (with respect to reactants) reaction mixture. This 70% concentrated mixture provides excellent results, in that high yields of the desired polyhydroxy fatty acid amide product are secured rapidly. Indeed, indications are that the reaction is substantially complete within one hour, or less. The consistency of the reaction mixture at the 70% concentration level provides ease of handling. Even better results are secured at the 80% and 90% concentration levels. However, at the higher concentrations the reaction systems are somewhat more difficult to work with, and require more efficient stirring (due to their thickness), and the like, at least in the early stages of the reaction. Once the reaction proceeds to any appreciable extent, the viscosity of the reaction system decreases and ease of mixing increases. In one mode, product yields can be increased a few percent by allowing the reaction mixture to "age" (even to solidify) a few hours or days to allow final traces of starting materials to react at lower temperatures.

Preparation of Polyhydroxyamine

Catalyst Treatment—Approximately 300 mls of RANEY NICKEL 4200 (Grace Chemicals) is washed with deionized water (1 liter total volume; 3 washings) and decanted. The total catalyst solids can be determined by the volume-weight equation provided by Grace Chemicals, i.e., [(total wt. catalyst+water)–(water wt. for volume)]×7/6=Nickel solids.

308.21 g. of the catalyst Ni solids basis are loaded into a 2 gallon reactor (316 stainless steel baffled autoclave with DISPERSIMAX hollow shaft multi-blade impeller from Autoclave Engineers) with 4 liters of water. The reactor is heated to 130° C. at 1400–1600 psig hydrogen for 50 minutes. The mixture is cooled to room temperature at 1500 psig hydrogen and left overnight. The water is then removed to 10% of the reactor volume using an internal dip tube.

Reaction—The reactants are as follows. 881.82 mls. 50% aqueous monomethylamine (Air Products, Inc.; Lot 060-889-09); 2727.3 g. 55% glucose syrup (Cargill; 71% glucose; 99 dextrose equivalents; Lot 99M501).

The reactor containing the $H_2O$ and Raney nickel prepared as noted above is cooled to room temperature and ice cold monomethylamine is loaded into the reactor at ambient pressure with $H_2$ blanket. The reactor is pressurized to 1000 psig hydrogen and heated to 50° C. for several minutes. Stirring is maintained to assure absorption of $H_2$ in solution.

The glucose is maintained in a separate reservoir which is in closed communication with the reactor. The reservoir is pressurized to 4000 psig with hydrogen. The glucose (aqueous solution) is then transferred into the reactor under $H_2$ pressure over time. (This transfer can be monitored by the pressure change in the reservoir resulting from the decrease in volume of the sugar solution as it is transferred from the reservoir into the main reactor. The sugar can be transferred at various rates, but a transfer rate of ca. 100 psig pressure drop per minute is convenient and requires about 20 minutes for the volume used in this run.) An exotherm occurs when the aqueous sugar solution is introduced into the reactor; the 50° C. internal temperature raises to ca. 53° C.

Once all the glucose has been transferred to the reactor the temperature is maintained at 50° C. for 30 minutes. Hydrogen uptake is monitored by a pressure gauge. Stirring is continued throughout at 800–1,100 rpm or greater.

The temperature of the reactor is increased to 60° C. for 40 minutes, then to 85° C. for 10 minutes, then to 100° C. for 10 minutes. The reactor is then cooled to room temperature and maintained under pressure overnight. The reaction product dissolved in the aqueous reaction medium is conveniently recovered by using an internal dip tube with hydrogen pressure. Particulate nickel can be removed by filtration. Preferably, an internal filter is used to avoid exposure to air, which can cause nickel dissolution. Solid N-methyl glucamine is recovered from the reaction product by evaporation of water.

The foregoing procedure can be repeated using fructose as the sugar to prepare N-methyl fructamines.

The foregoing procedure can also be repeated using glyceraldehyde as the sugar to prepare N-methyl glycerol amine (3-methylamino-1,2-propanediol).

Conversion of Polyhydroxy Amine to Polyhydroxy Fatty Acid Amide Surfactant Reaction Product and Minimization of Nascent Fatty Acids by the Secondary Reaction As the initial step, the substantially water-free N-methyl glucamine prepared above is reacted with fatty acid methyl esters to prepare the corresponding fatty acid amides of N-methyl glucamine in the manner disclosed above and in the experimental details, hereinafter. It will be appreciated that coconut fatty acid methyl esters, palm oil fatty acid esters, tallow fatty acid esters, oleyl esters, polyunsaturated fatty acid esters, and the like, can all be used in this reaction, and various N-alkyl polyols, e.g., N-methyl fructamine, N-methyl maltamine, etc., can be used in place of the N-methyl glucamine.

The secondary reaction can thereafter be carried out using primary alkyl amines and alkanolamines. However, it will be appreciated by the chemist that, since alkyl amines generally have undesirable odors, as compared with alkanolamines, it is preferred to employ the alkanolamines. By so doing, removal of traces of unreacted amine material from the final product of the process is unnecessary, since products with improved odor are secured.

Moreover, while secondary amines will function adequately in the process herein to remove the nascent sources of fatty acids, such amines can undesirably form nitrosamines. Accordingly, the primary amines, especially the primary alkanolamines such as ethanolamine ("monoethanolamine") are much preferred for use in the secondary reaction herein.

It will be further appreciated that it is desirable that the secondary reaction herein be carried out quickly, such that decomposition of the desired polyhydroxy fatty acid amide surfactant is kept to a minimum. In essence, the secondary reaction is an amidation reaction, and seems to be potentiated and accelerated by having a solvent supportive of nucleophilic reaction present. Since methanol is such a solvent, and is also one of the preferred solvents for use in the primary reaction herein, it suffices quite well to also act as the solvent for the secondary reaction. Preferably, at least about 6–8% by weight of such solvent which is supportive of nucleophilic reactions, especially methanol, is used in the secondary reaction of this invention, as well as some 1,2-propanediol. 1,2-propanediol, alone, can also serve as the solvent for the secondary reaction, but does not appear to be quite as effective as when methanol is present. Other lower alcohols, such as ethanol and iso-propanol, could also be used, but may be poorer choices than methanol or mixtures of methanol/1,2-propanediol. Under such circumstances, some minimal loss (about a 1% decrease in overall yield) of polyhydroxy fatty acid amide surfactant may be unavoidable, but this is usually an acceptable trade-off for the desired decrease in fatty acids in the final product.

The reaction temperature for the secondary reaction should preferably be about 85° C., or below, typically in the 65° C.–85° C. range. It will be appreciated that use of excessively high temperatures may desirably speed the secondary reaction, but will undesirably begin to cause cyclization of the polyhydroxy fatty acid amides. While temperatures up to about 120° C. might be tolerable for short periods of time, it would, of course, be undesirable to decrease nascent fatty acid content at the expense of increasing the level of cyclized by-product. The following further illustrates the Primary Reaction followed by the Secondary Reaction.

Apparatus: 500 ml three necked flask, paddle stirrer, reflux condenser with drying tube, thermometer reaching into reaction and a gas inlet tube. The flask is heated with a thermostatted oil bath.

Primary Reaction

The apparatus is predried under nitrogen sweep, cooled and the sweep is shut off. A tare weight is taken without the condenser. Pure powdered N-methylglucamine ("NMG") 97.5 g (0.5 mole), 107 g (0.5 mole). 95% methyl dodecanoate and 18.9 g propylene glycol (solvent) are placed into the flask; the moisture content of each reactant is, respectively, 0.3% and 0.1%, and the solvent is dried over molecular sieves. The mixture is heated to 68° C. with stirring to give a viscous paste; 5.4 g (0.025 mole) 25% sodium methoxide in methanol is then added. The time is taken as zero, and the reaction then brought quickly to 85° C., and held at 85° C. with continuous stirring, no vacuum, no nitrogen sweep. Within 5 minutes a thin milky suspension is formed which clears to a homogeneous clear low viscosity liquid at 55 minutes. During this reaction no reflux is observed, although methanol evolution is calculated to reach 9.1% at complete amidation with NMG. At 150 minutes, the weight of the reaction is within 2 g of initial; a small sample is taken.

In an alternate mode, various surfactants, especially nonionic surfactants such as the ethoxylated alcohols (NEODOL), as well as alkyl glycosides and pre-formed polyhydroxy fatty acid amides, can be present in the reaction mixture (typically 5–30%) to help provide a single phase mixture.

Secondary Reaction

Immediately following the Primary Reaction, 7.6 g (0.125 mole) of dry ethanolamine is added. Vacuum/nitrogen sweep is then applied as stirring and temperature are maintained. At the 210 minute point the vacuum reaches 11 psi (4 psi absolute). Weighing indicates about 1.5 to 2% of reaction weight in excess of theoretical removal of all methanol from catalyst and ester. The resulting product has the following analysis and is suitable for use in high sudsing detergent compositions.

| | GC Area % | Calculated Concentrations |
|---|---|---|
| Methyl ester | 0.1% | 0.1% |
| Fatty acid/soap | 0.3% | 0.2% |
| NMG | 6.5% | 5.5% |
| Monoethanol amide | 2.6% | 2.2% |
| Total glucose amide | 89.9% | 76.4% |
| $C_{10}$ | 1.1% | 0.9% |
| $C_{12}$ | 87.6% | 74.5% |

-continued

| | GC Area % | Calculated Concentrations |
|---|---|---|
| $C_{14}$ | 1.2% | 1.0% |
| Ester amide | 0.1% | 0.1% |
| Assumed components not observed in GC | | |
| Propylene glycol | | 10.0% |
| Methanol | | 2.0% |
| Monoethanolamine | | 3.0 |
| TOTAL | | 99.5% |

The sugar-derived polyhydroxy fatty acid amides used herein have a linear hydrocarbyl chain Z containing at least three hydroxyl groups and are generally prepared as noted above. For polyhydroxy fatty acid amides derived from glycerol, hydrocarbyl chain Z contains two hydroxyl groups, and the reaction sequence for their preparation can optionally be somewhat different, as noted below. Such materials are formally named as N-(1,2-propanediol) fatty acid amides, and are provided by various reaction sequences, as noted hereinafter.

Alkyl Alkoxylated Sulfates

The alkyl alkoxylated sulfate surfactants used herein are the salts or acids of the formula $RO(A)_mSO_4M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{14}$–$C_{18}$ alkyl or hydroxyalkyl, A is an ethoxy (preferred) or propoxy unit, m represents the average degree of ethoxylation and is greater than zero, typically between about 0.5 and about 6.5, more preferably between about 0.5 and about 3.5, and M is H or a cation which can be, for example, a metal cation (e.g., sodium, potassium, magnesium, etc.), ammonium or substituted-ammonium cation. Specific examples of substituted ammonium cations include methyl-, dimethyl-, trimethyl-ammonium, dimethyl piperdinium, and cations derived from alkanolamines, e.g., monoethanolamine, diethanolamine, and triethanolamine, and mixtures thereof. Non-lithium cations are preferred. Thus, alkyl ethoxylated sulfates as well as alkyl propoxylated sulfates are contemplated herein, with the former being preferred. Such surfactants are typically abbreviated as "AEmS" with m designating the degree of alkoxylation. Exemplary surfactants are $C_{12}$–$C_{18}$ alkyl polyethoxylate (1.0) sulfate (AE1S), $C_{12}$–$C_{18}$ alkyl polyethoxylate (2.25) sulfate (AE2.25S), $C_{12}$–$C_{18}$ alkyl polyethoxylate (3.0) sulfate (AE3S), and $C_{12}$–$C_{18}$ alkyl polyethoxylate (4.0) sulfate (AE4S), conveniently in the sodium or potassium form. Such surfactants are commercially available from a variety of sources.

Gel Formation

The general procedure for preparing the gels of the instant invention involves dissolving the alkyl alkoxylated sulfate in water followed by addition and dissolution of the polyhydroxy fatty acid amide. This dissolution step is typically carried out at somewhat elevated temperatures to assist dissolution and processing; temperatures in the range of 140° F.–185° F. (60° C.–85° C.) are typical. If lower temperatures are used, the formulator may find it more convenient to dissolve the polyhydroxy fatty acid amide first. If metal cations such as magnesium are to be included in the gels, it is preferred that the cation salt be dissolved in the water prior to addition of either surfactant. Optional perfumes, colorants, etc. can be added at any time. Stirring is used throughout this dissolution/mixing step.

The resulting solutions are flowable liquids and can be handled as such, e.g., to fill packaging containers, etc. On cooling to ambient temperatures and standing, the gels form spontaneously. Typically, gelling requires up to about 3 hours upon cooling. Gels which contain higher concentrations of magnesium salts or other electrolytes usually gel at a slower rate. Gels which contain magnesium ions in the form of an ethoxylated sulfate surfactant are formed rapidly, provided that only low levels of electrolytes are present in the formulation. Advantageously, if the gels should later break due to exposure to unduly high storage temperatures, the resulting liquids remain homogeneous and spontaneously revert to the gel state on cooling.

The gels of the present invention may optionally use processing aid additives. Such additives, present in 1–45% concentrations, are nonionic or anionic compounds containing an amide functionality and up to six aliphatic carbons. Examples of suitable additives include formamide, acetamide, urea, homologs and analogs of urea such as methyl urea, ethyl urea and mixtures thereof. The most preferred additive is urea at levels of about 15% to about 30%, depending somewhat on the amount of surfactant present. Formulations containing urea are typically processed as low viscosity liquids which cool to form beautiful gels. While not intending to be limited by theory, it has been found preferable to buffer formulations which contain urea with a weak acid. Examples of preferred weak acids include citric acid, formic acid, acetic acid, boric acid, and mixtures thereof. The ratio of urea to acid buffer is preferably from about 2:1 to 25:1, most preferably from about 5:1 to 20:1.

Gels prepared in the foregoing manner have a smooth, homogeneous consistency, are transparent or translucent, and have a viscosity preferably in the range of about 1,000,000 to about 4,000,000 cps. Viscosity measurements of the gels of this invention are taken by means of an Exact Viscometer HAAKE RV20 ROTOVISCO using Cone PK1; 1° with M=30.2. The viscosity of the gels is measured on a 1 gram sample of the gel sandwiched between the Cone and the instrument's plate, using a shear gradient from 0 to 3 $sec^{-1}$ over 200 seconds at a temperature of 23° C.

Additional Ingredients

The gels herein are tolerant of various ingredients including various perfumes, coloring agents, sanitizing agents, and the like, which are typically used at levels from about 0.01% to about 1%. Long-chain alcohols, e.g., $C_{12}$–$C_{18}$ and ethoxylated derivatives thereof can also be present, typically at levels up to about 15% of the total gel. Amine oxide, betaine and sulfobetaine surfactants having a $C_{10}$–$C_{18}$, preferably $C_{12}$–$C_{14}$ hydrocarbyl, substituent are used in preferred gels herein. The amine oxide surfactants and betaine surfactants are especially preferred in compositions which contain magnesium cations, calcium cations, or mixtures thereof, to help incorporate the cations into the gel. Such surfactants also enhance the sudsing qualities and cleaning performance of the gel. These surfactants will typically comprise from about 0.5% to about 10%, preferably at least about 1%, of the gel formulations herein.

The gelled compositions herein should be substantially free of interfering amounts of ingredients which can contribute to "breaking" the gel structure. For example, hydrotroping agents such as cumene sulfonate and xylene sulfonate are preferably not present. High ionic strength materials such as sodium chloride or magnesium sulfate are preferably not present above 4% levels. Short-chain alcohols such as ethanol and methanol, and glycols such as propylene glycol are preferably not present, or, if present by virtue of their having been used in the manufacture of the polyhydroxy fatty acid amide or alkyl ethoxylated sulfate surfactant, are most preferably at levels below about 8%, more preferably below about 4%. Indeed, it will be appreciated that minor amounts, e.g., about 2% or less of any of the foregoing materials may be present in the gels of this invention, but at some risk to stability, especially on long storage. Accordingly, such potential gel-breakers are preferably avoided herein.

The following illustrates the preparation of typical gels of this invention.

EXAMPLE I 77.27 grams of water, 144.23 grams of NaAE1S (26% active sodium salt of $C_{12}$–$C_{13}$ alkyl ethoxy sulfate, average 1 ethoxy group, STANDAPOL ES-1 Henkel) are mixed at 185° F. (85° C.) using a Lightnin LABMASTER M5V1500, MSV1500U mixer. After dissolution, 28.5 grams of the fatty acid amide of N-methyl glucamine (83% active palm stearin $C_{16}$–$C_{18}$ N-methyl glucamide) are added at the same temperature, with mixing. (A bit of difficulty may be noted in dissolving all the glucamide surfactant.) The final product is a liquid, which cools to form a slightly hazy gel at room temperature. The gel comprises 10% of the glucose amide surfactant and 16% of the AE1S surfactant.

EXAMPLE II

To a solution formed by dissolving 0.002 grams of blue dye in 41.92 grams of water at 143° F. (62° C.), 0.50 grams of $MgSO_4$, 0.50 grams of perfume and 35.0% of 50% coconutalkyl $C_{12}$–$C_{14}$ N-methyl glucamide paste are added with agitation. Once all the materials are dissolved, 21.88 grams of an 80% Na $C_{12-13}$AE1S paste is added. The solution is stirred for an additional 30 minutes at 170° F. (77° C.). The final product is a viscous liquid which quickly solidifies into a gel after cooling. The gel comprises 0.5% $MgSO_4$, 17.5% of the glucamide surfactant, 17.5% of the AE1S surfactant and has a viscosity of 1,700,000 cps.

The gel formed in Example II is slightly hazy. A transparent gel can be formed by simply deleting the $MgSO_4$.

The incorporation of magnesium cations in the gels of this invention enhances cleaning performance, especially with regard to greasy soils of the type typically encountered in dishwashing operations. Unfortunately, the presence of ionic ingredients does tend to decrease gel viscosity. For lower viscosity gels herein (500,000–1,500,000 cps) the addition of common magnesium salts such as magnesium chloride, magnesium sulfate, magnesium formate, magnesium citrate, and the like can also be used to selectively control final product viscosity. For gels of higher viscosity (above about 2,000,000 cps) such magnesium salts disrupt the desired physical properties and such common magnesium salts are preferably not used above about 0.3% levels. In order to overcome this problem and to allow the formulator to incorporate magnesium cations at levels of about 0.5% and greater, generally up to about 2%, typically 0.5%–1.5%, in the finished gels, it is preferred to add at least some of the magnesium in the form of the magnesium salt of the anionic surfactant. Stated otherwise, all of the magnesium cations can be added as the magnesium form of the surfactant, or part can come from the magnesium surfactant and part from other magnesium salts, as noted above. The magnesium form of the alkyl alkoxy sulfate surfactant can be generated in situ by combining $Mg(OH)_2$ with the acid form of the surfactant during the mixing step herein. In an alternate mode, the use of other surfactants such as the $C_{16}$ dimethyl amine oxides and/or $C_{12-14}$ betaine surfactants will assist in the performance of magnesium-containing gels.

In yet another mode which is designed to enhance the grease removal performance of the instant compositions, calcium ions, or, more preferably, a mixture of calcium and magnesium ions, are incorporated into the gel. Levels of calcium or mixed calcium/magnesium ions up to about 2%, typically from about 0.4% to about 1.5%, provide superior grease removal in a hand dishwashing operation. Ratios of Ca:Mg of from about 5:1 to about 1:5, are preferably used. In one mode, the gel is prepared using a calcium salt and the magnesium form of the AEmS surfactant. Alternatively, water-soluble calcium and magnesium salts such as the halides, sulfates, hydroxides, and the like, can be used.

EXAMPLE III 53.78 grams of water, 6.67 grams of coconut alkyl $C_{12-14}$ amide propyl betaine (30% solution in water), and 0.50 grams of calcium formate are mixed at ambient temperature, 75° F. (24° C.). The homogeneous solution is then heated to 160° F. (71° C.) 8.00 grams of $C_{10}E_8$ (100% active, ethoxylated alcohol, average 8 ethoxy groups) and 22.86 grams of $Mg(AE_3S)_2$ (70% active, magnesium neutralized ethoxylated alcohol sulfate, average 3 ethoxy groups, ELFAN NS 2435 Mg conc. by Akzo). The resulting solution is further heated to 180° F. and 8.20 grams of coconut alkyl $C_{12-14}$ N-methyl glucamide (97.8% active) are added with stirring. The processed product is a clear fluid liquid which gels upon cooling. The viscosity of the gel is measured at 1,100,000 cps.

EXAMPLE IV

A gel composition containing an amine oxide surfactant to promote sudsing and cleaning is as follows. 10.41 grams of $C_{10-16}$ dimethyl amine oxide (32.0% active, Procter & Gamble, USA) and 20.49 grams of 97.6% active coconut N-polyhydroxy alkyl fatty acid amide are added to 40.53 grams of water at 150° F. (65° C.). The mixture is then heated and agitated using a Lightnin Labmaster MSV1500U mixer. At 180° F. (82° C.), 28.57 grams of ELFAN NS-243 S Mg conc. (70% active, Akzo, Germany) are added and agitation is continued for 2 hours at 180° F. (82° C.). The final product is a clear liquid which quickly settles into a gel upon cooling. Viscosity of the gel at room temperature: 2.3 million cps.

EXAMPLE V

A gel composition containing urea is as follows. To 1.65 grams of magnesium sulfate and 6.67 grams of coco amido propyl betaine (30% active, Albright-Wilson, United Kingdom) dissolved in 25.42 grams of water, 8.00 grams of C91-8T Dobanol (100% active, Shell, USA), 1.00 grams of boric acid and 20.20 grams of urea (99% active, Fisher Scientific, USA) are added and mixed at 160°–165° F. (71°–74° C.). Once a homogeneous mixture is obtained, 8.20 grams of 97.6% active coconut N-polyhydroxy alkyl fatty acid amide and 28.86 grams of Na $C_{12-14}AE_3S$ (69.3% active, South Pearl, Puerto Rico, USA) are added and agitation is continued. The final product is a liquid which, upon cooling, forms a water-white clear gel. Gel viscosity: 1.6 million cps.

What is claimed is:

1. Detergent compositions in middle phase gel form, comprising water and at least about 15% by weight of total gel of a mixture of a polyhydroxy fatty acid amide surfactant (a) and an alkyl alkoxylated sulfate surfactant (b), said mixture of surfactants (a) and (b) being in a weight ratio of from about 10:1 to about 1:1, said detergent compositions being substantially free of polymeric gelling agents and hydrotroping agents, and said detergent compositions having a viscosity in a range from about 1,000,000 to about 4,000,000 cps.

2. A gel composition according to claim 1 which comprises at least about 20% by weight of the mixture of surfactants (a) and (b).

3. A gel composition according to claim 1 which additionally comprises a source of magnesium ions, a source of calcium ions, or mixtures thereof.

4. A gel composition according to claim 3 wherein said source of magnesium ions comprises the magnesium salts of said alkyl alkoxylated sulfate surfactant.

5. A gel composition according to claim 4 which comprises at least about 1% by weight of said magnesium salts of the alkyl alkoxylated surfactant.

6. A gel composition according to claim 1 which additionally comprises a surfactant which is a member selected from the group consisting of ethoxylated alcohols, amine oxides, betaines, sultaines, and mixtures thereof.

7. A gel composition according to claim 6 which additionally comprises a source of magnesium ions, a source of calcium ions, or mixtures thereof.

8. A method for cleansing dishware by applying thereto a gel composition according to claim 1 in the presence of water and mechanical agitation.

9. A method for cleansing dishware by applying thereto a gel composition according to claim 3 in the presence of water and mechanical agitation.

10. A gel composition according to claim 1 which additionally comprises urea, or homologs and analogs of urea.

* * * * *